US009536485B2

(12) United States Patent
Chen et al.

(10) Patent No.: US 9,536,485 B2
(45) Date of Patent: Jan. 3, 2017

(54) GAMMA VOLTAGE GENERATING MODULE AND LIQUID CRYSTAL PANEL

(71) Applicant: SHENZHEN CHINA STAR OPTOELECTRONICS TECHNOLOGY CO., LTD., Shenzhen, Guangdong (CN)

(72) Inventors: Lixuan Chen, Guangdong (CN); Chih-tsung Kang, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 171 days.

(21) Appl. No.: 14/387,085

(22) PCT Filed: Aug. 22, 2014

(86) PCT No.: PCT/CN2014/085042

§ 371 (c)(1),
(2) Date: Sep. 22, 2014

(87) PCT Pub. No.: WO2016/026149

PCT Pub. Date: Feb. 25, 2016

(65) Prior Publication Data

US 2016/0049118 A1 Feb. 18, 2016

(30) Foreign Application Priority Data

Aug. 18, 2014 (CN) ..... 2014 1 0410153

(51) Int. Cl.
*G09G 3/36* (2006.01)

(52) U.S. Cl.
CPC ..... *G09G 3/3648* (2013.01); *G09G 3/3696* (2013.01); *G09G 2300/0447* (2013.01);
(Continued)

(58) Field of Classification Search
CPC ..... G09G 2300/0447; G09G 2320/0276
See application file for complete search history.

(56) References Cited

U.S. PATENT DOCUMENTS 6,731,259 B2 * 5/2004 Yer ..... G09G 3/3696 345/89
6,762,737 B2 * 7/2004 Kajihara ..... G09G 3/2011 345/211

(Continued)

FOREIGN PATENT DOCUMENTS

CN 101458914 6/2009
CN 101548914 6/2009

*Primary Examiner* — Amare Mengistu
*Assistant Examiner* — Shawna Stepp Jones
(74) *Attorney, Agent, or Firm* — Brooks Kushman P.C.

(57) ABSTRACT

A Gamma voltage generating module for supplying a liquid crystal panel having a plurality of pixel units, each including comprising a main pixel region M and a sub pixel region S. The Gamma voltage generating modules have a reference voltage unit source to a first divider resistance string for dividing the reference voltages to form Gamma voltages corresponding to 0-255 gray scales, and supplying the Gamma voltages to the main pixel region M; and a second divider resistance string, coupled to the reference voltage unit, for forming Gamma voltages corresponding to 0-255 gray scales, and supplying the Gamma voltages to the sub pixel region S. The first divider resistance string and the second divider resistance string, the Gamma voltage generating points at least at gray scales of 0, Gx, Gx+1 and 255 connect with the reference voltages. Also discloses a liquid crystal panel comprising the above Gamma voltage generating module.

20 Claims, 8 Drawing Sheets

(52) U.S. Cl.
CPC ..... *G09G 2320/0242* (2013.01); *G09G 2320/0276* (2013.01)

(56) References Cited

U.S. PATENT DOCUMENTS

| | | | | |
|---|---|---|---|---|
| 7,006,114 | B2 * | 2/2006 | Sakaguchi | G09G 3/3696 345/100 |
| 7,375,710 | B2 * | 5/2008 | Tobita | G09G 3/3688 345/100 |
| 8,139,010 | B2 * | 3/2012 | Shih | G09G 3/3607 345/87 |
| 2006/0214895 | A1 * | 9/2006 | Shih | G09G 3/3607 345/88 |

* cited by examiner

GAMMA VOLTAGE GENERATING MODULE AND LIQUID CRYSTAL PANEL

CROSS-REFERENCE TO RELATED APPLICATION

This application is the U.S. national phase of PCT Application No. PCT/CN2014/085042 filed on Aug. 22, 2014, which claims priority to CN Patent Application No. 201410410153.3 filed on Aug. 18, 2014, the disclosures of which are incorporated in their entirety by reference herein.

TECHNICAL FIELD

The present invention relates to a liquid crystal display, in particular relates to a Gamma voltage generating module in the liquid crystal display and a liquid crystal panel including the Gamma voltage generating module.

BACKGROUND ART

A Liquid Crystal Display (LCD) is a display device with a thin plane, formed by a certain number of color pixels or black and white pixels and disposed in front of a light source or a reflective panel. The liquid crystal display is favored by everyone and becomes a mainstream display due to its low power consumption, high-definition, small size and light-weight etc. The liquid crystal display is widely used in various electronic products like a computer device having a display screen, a mobile phone or a digital photo frame and so on, and wide visual angle technology is one of the developing focuses of the liquid crystal display at present. However, if a side visual angle or a squint angle is too large, color shift phenomenon may occur in the wide-visual-angle liquid crystal display.

As for the problem of color shift in the wide-visual-angle liquid crystal display, a 2D1G technology is employed in the field at present for improvement. The so-called 2D1G technology is a technology, wherein dividing every pixel unit in the liquid crystal panel into a main pixel region and a sub pixel region of which areas are different from each other, and the main pixel region and the sub pixel region in the same pixel unit connect to different data lines and the same gate line. By inputting different data signals (different gray scale values) into the main pixel region and the sub pixel region, different display brightness and squint brightness are generated, thereby decreasing the color shift generated by viewing from the side or at a squint angle. One pixel unit has one gray scale value, by setting gray scale values of each of the main pixel region and the sub pixel region, the combination of the gray scale values of the main pixel region and the sub pixel region can achieve the purpose of decreasing the color shift.

In the actual hardware device, the liquid crystal display panel is driven by a gate driving module and a source driving module respectively providing a scanning signal and a data signal to the liquid crystal display unit, a voltage difference between different data signal voltages and the common electrode voltage causes different rotation angles of the liquid crystal, thus a difference in brightness will be generated, that is to say, the display of the liquid crystal panel forms different gray scales. In the liquid crystal panel, a relationship curve between a data signal voltage and a gray scale is called Gamma curve, take a 8-bit liquid crystal panel for example, it can display $2^8=256$ gray scales, which are corresponding to 256 different Gamma voltages, and the Gamma voltage is 2 to the N-th power parts divided from the changing process from white to black. Therefore, in the 2D1G technology, it is needed to generate two groups of Gamma voltages of 0-255 gray scales.

SUMMARY

On this account, the present invention provides a Gamma voltage generating module so as to solve the problem in 2D1G technology that it is necessary to provide two groups of Gamma voltages of 0-255 gray scales to the liquid crystal panel.

In order to achieve the above purpose, the present invention employs a technical solution as follows:

A Gamma voltage generating module for supplying Gamma voltage to a liquid crystal panel comprising a plurality of pixel units, each of the pixel unit comprising a main pixel region M and a sub pixel region S, wherein the Gamma voltage generating module comprises:

a reference voltage unit for supplying reference voltages to a divider resistance string;

a first divider resistance string, coupled to the reference voltage unit, for dividing the reference voltages to form Gamma voltages corresponding to 0-255 gray scales, and supplying the Gamma voltages to the main pixel region M; and a second divider resistance string, coupled to the reference voltage unit, for dividing the reference voltages to form Gamma voltages corresponding to 0-255 gray scales, and supplying the Gamma voltages to the sub pixel region S;

wherein in the first divider resistance string and the second divider resistance string, the Gamma voltage generating points at least at gray scales of 0, Gx, Gx+1 and 255 connect with the reference voltages; wherein Gx refers to a gray scale corresponding to a brightness inversion when a gray scale G of a pixel unit is converted to a combination of a gray scale Gm of the main pixel region M and a gray scale Gs of the sub pixel region S.

Wherein the Gamma voltage generating points at gray scales of 0, 32, 128, Gx, Gx+1 and 255 connect with the reference voltages.

Wherein the reference voltages respectively connecting to the first divider resistance string and the second divider resistance string are different.

Wherein the following method is adopted to covert the gray scale G of a pixel unit into the combination of the gray scale Gm of the main pixel region M and the gray scale Gs of the sub pixel region S, the method comprising:

S101: acquiring an actual brightness value $Lv\alpha$ of each gray scale G of the liquid crystal panel at a front angle $\alpha$;

S102: acquiring an actual brightness value $Lv\beta$ of each gray scale G of the liquid crystal panel at a squint angle $\beta$;

S103: dividing each pixel unit of the liquid crystal panel into the main pixel region M and the sub pixel region S of which an area ratio is a:b, and dividing the actual brightness values $Lv\alpha$ and $Lv\beta$ according to the following formulae:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;$$

acquiring actual brightness values $LvM\alpha$ and $LvM\beta$ of each gray scale G where the main pixel region M is at the front angle $\alpha$ and the squint angle $\beta$, respectively; acquiring actual brightness values $LvS\alpha$ and $LvS\beta$ of each gray scale G respectively where the sub pixel region S is at the front angle $\alpha$ and the squint angle $\beta$;

S104: according to actual brightness values $Lv\alpha(max)$ and $Lv\beta(max)$ of a maximum gray scale max acquired in steps S101 and S102, calculating theoretical brightness values LvGα and LvGβ of each gray scale G where the liquid crystal panel is at the front angle α and the squint angle β in conjunction with the formulae:

$$\text{gamma}(\gamma) = 2.2 \text{ and } \left(\frac{G}{\max}\right)^{\gamma} = \frac{LvG}{Lv(\max)};$$

S105: with respect to a gray scale Gx of the pixel unit, if gray scales input in the main pixel region M and the sub pixel region S are Gmx and Gsx respectively, actual brightness values LvMxα, LvMxβ, LvSxα and LvSxβ are acquired according to result of step S103, and theoretical brightness values LvGxα and LvGxβ are acquired according to result of step S104, calculating the following formulae:

$$\Delta 1 = LvMx\alpha + LvSx\alpha - LvGx\alpha;$$

$$\Delta 2 = LvMx\beta + LvSx\beta - LvGx\beta;$$

$$y = \Delta 1^2 + \Delta 2^2;$$

when y reaches a minimum value, setting corresponding gray scales Gmx and Gsx as gray scales being respectively input into the main pixel region M and the sub pixel region S when the pixel unit is at the gray scale Gx;

S106: repeating step S105 with respect to each gray scale G of the pixel unit, and acquiring the gray scales Gm and Gs being input into each of the main pixel region M and the sub pixel region S respectively from among all gray scales of the liquid crystal panel.

Wherein the front angle is 0°, and the squint angle is 30-80°.

Wherein the squint angle is 60°.

Wherein the gray scales of the liquid crystal panel includes 256 gray scales from 0 to 255, wherein a maximum gray scale max is 255 gray-scale.

Wherein the actual brightness values Lvα and Lvβ are determined according to gamma curves acquired when the liquid crystal panel is at the front angle α and at the squint angle β.

Wherein after step S106, a Gm-Lv curve of a relationship between gray scale and brightness of the main pixel region M, and a Gs-Lv curve of a relationship between gray scale and brightness of the sub pixel region S are obtained, and singular points appeared in the Gm-Lv curve and the Gs-Lv curve are processed by using a locally weighted scatter plot smoothing method or processed by using power function fit, wherein an expression of the power function is: f=m*x^n+k.

Another aspect of the present invention provides a liquid crystal panel, comprising:

a plurality of pixel units, each of the pixel units comprising a main pixel region M and a sub pixel region S driven by same scanning signals and different data signals;

a gate driving module for supplying the scanning signals to the pixel units;

a source driving module for supplying the data signals to the pixel units;

a Gamma voltage generating module for supplying two groups of Gamma voltages to the source driving module, such that the source driving module supplies the data signals to each of the main pixel region M and the sub pixel region S, wherein the Gamma voltage generating module is the Gamma voltage generating module as mentioned above.

Compared to the prior art, the Gamma voltage generating unit provided in present invention can generate two groups of Gamma voltages of 0-255 gray scales to drive the main pixel region and the sub pixel region respectively in the 2D1G technology; and with respect to each group of the Gamma voltages, only Gamma voltage generating points at gray scales of 0, Gx, Gx+1 and 255 connected with the reference voltages needs to be voltage-bound, so that a number of bound voltages becomes small, thereby a difficulty of designing and producing a driving IC is lowered, and its manufacturing cost is saved.

DETAILED DESCRIPTION OF EXEMPLARY EMBODIMENTS

The present invention is described below in details with reference to the embodiments and the accompanying drawings, in order to better elaborate the technical features and the structures of the present invention.

Figure 1:
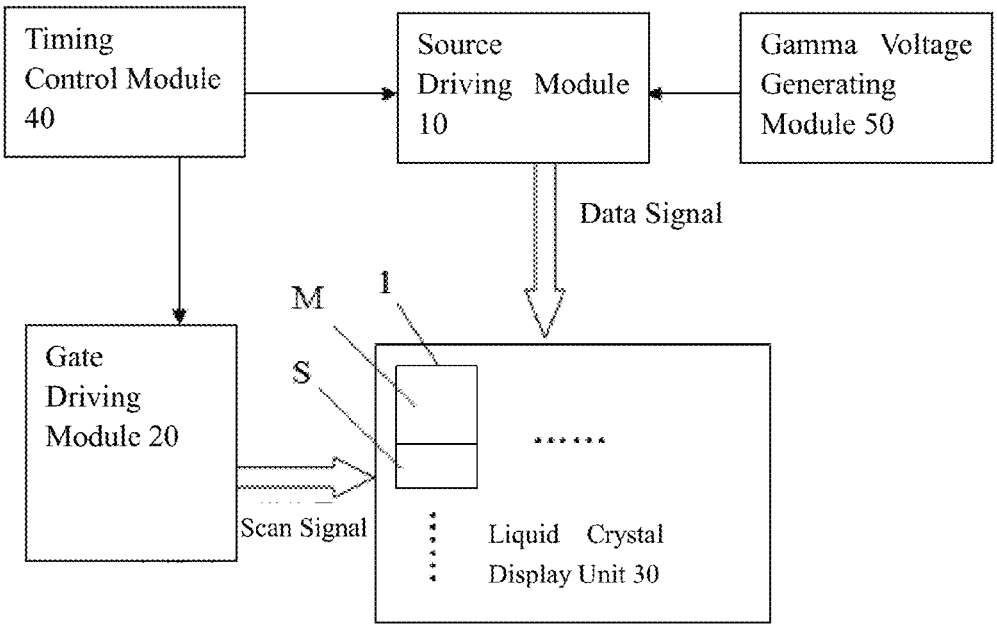
FIG. 1 is a structure diagram of a liquid crystal panel provided in an embodiment of the present invention.
Figure 2:
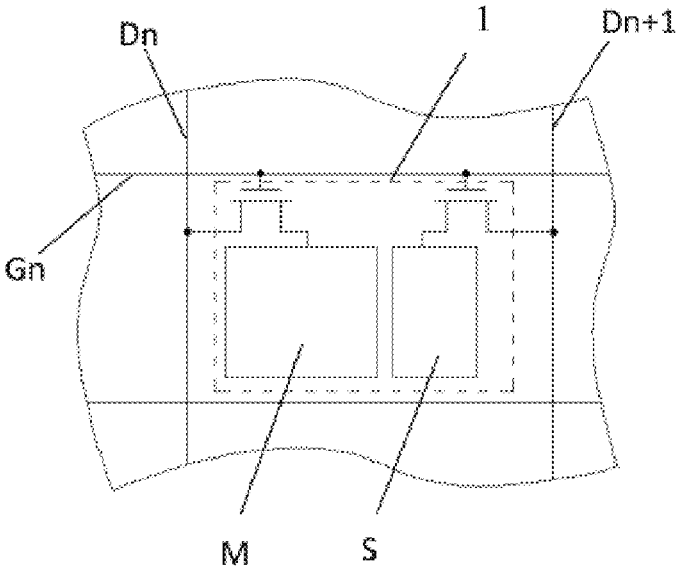
FIG. 2 is a diagram of a part of pixel units of a liquid crystal panel provided in an embodiment of the present invention.

FIG. 1 is a structure diagram of the liquid crystal panel provided in the present embodiment; FIG. 2 is a diagram of a part of pixel units of the liquid crystal panel in the present embodiment. As shown in FIG. 1, the liquid crystal panel provided in the present embodiment includes a source driving module 10, a gate driving module 20, a liquid crystal display unit 30, and a Gamma voltage generating unit 50, wherein each of the source driving module 10 and the gate driving module 20 is controlled by a timing control module 40, and provides data signal and scanning signal to the liquid crystal display unit 30. Further, the liquid crystal display unit 30 includes a plurality of pixel units 1 (the figure only shows one exemplary unit thereof), each pixel unit 1 includes a main pixel region M and a sub pixel region S, and the area ratio between the main pixel region M and the sub pixel region is a:b.

As shown in FIG. 2, the main pixel region M and the sub pixel region S in the same pixel unit 1 connect to different data lines Dn, Dn+1 and a same scanning line Gn. The data signals with different gray-scale values are respectively provided to the main pixel region M and the sub pixel region S via the data lines Dn and Dn+1, and the scanning signal is provided to the main pixel region M and the sub pixel region S via the scanning line Gn, that is to say, the main pixel region M and the sub pixel region S in the same pixel unit 1 may be turned on by the same scanning signal.

Figure 3:
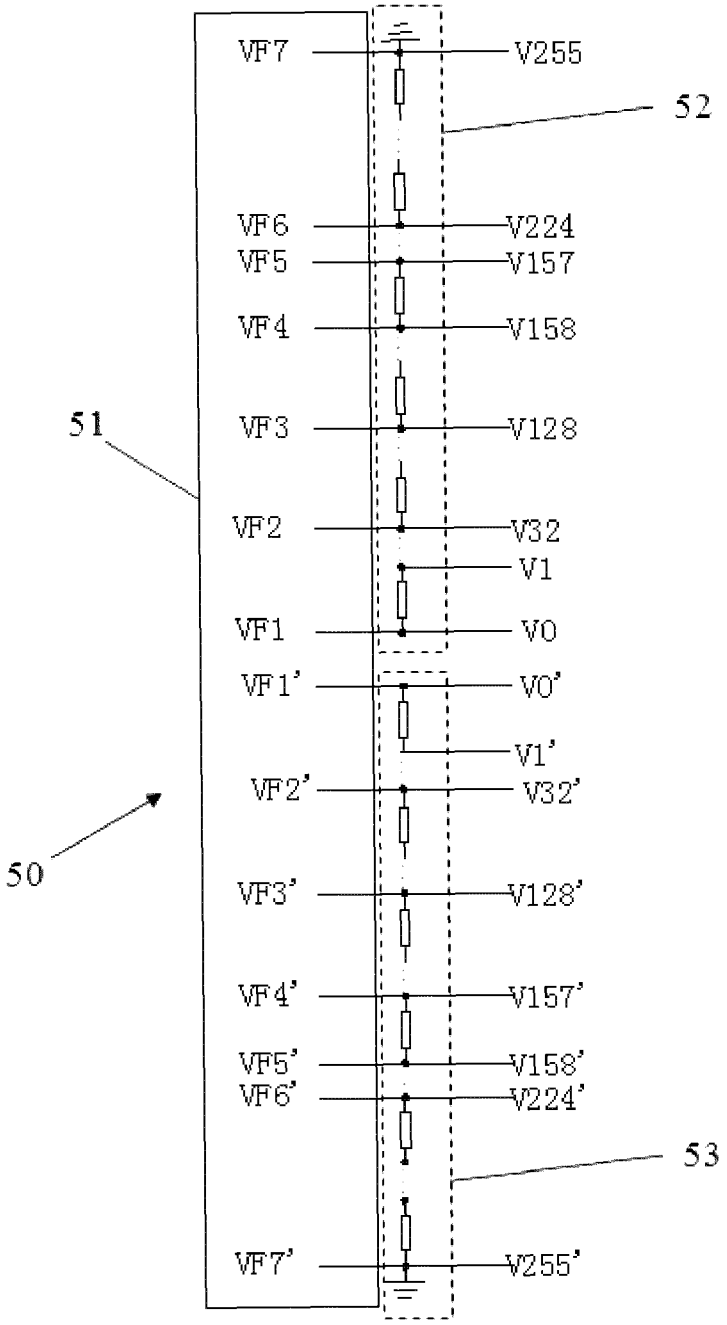
FIG. 3 is a structure diagram of a Gamma voltage generating unit provided in an embodiment of the present invention.

As shown in FIG. 3, a Gamma voltage generating module 50 includes: a reference voltage unit 51 for supplying reference voltages to divider resistance strings 52 and 53; a first divider resistance string 52, coupled to the reference voltage unit 51, for dividing the reference voltages to form Gamma voltages V0-V255 corresponding to 0-255 gray scales, and supplying the Gamma voltages to the main pixel region M through the source driving module 10; and a second divider resistance string 53, coupled to the reference voltage unit 51, for dividing the reference voltages to form Gamma voltages V0'-V255' corresponding to 0-255 gray scales, and supplying the Gamma voltages to the sub pixel region S through the source driving module 10. In the first divider resistance string 52, Gamma voltage generating points at gray scales of 0, 32, 128, Gx, Gx+1 and 255 connect with the reference voltages VF1, VF2, VF4, Vf5, VF6 and VF7, and a voltage binding is performed; and in the second divider resistance string 53, Gamma voltage generating points at gray scales of 0, 32, 128, Gx, Gx+1 and 255 connect with the reference voltages VF1', VF2', VF4', Vf5', VF6' and VF7', and a voltage binding is performed. In other embodiments, the reference voltages bound in the first divider resistance string 52 and the second divider resistance string 53 can only be connected to Gamma voltage generating points at gray scales of 0, Gx, Gx+1 and 255, that is, in the technical solution provided in the present invention, with respect to the first divider resistance string 52 and the second divider resistance string 53, the voltage binding is performed at least at the Gamma voltage generating points at gray scales of 0, Gx, Gx+1 and 255; as for other points, binding may be selectively performed according to actual needs. The more of the number of bound reference voltages, an accuracy of the generated Gamma voltage is higher, and the cost is higher as well; the less of the number of bound reference voltages, an accuracy of the generated Gamma voltage is decreased, and the cost is reduced as well.

In the liquid crystal panel as provided above, by inputting different data signals (different gray scales) into the main pixel region and the sub pixel region, different display brightness and squint brightness may be generated, such that a color shift generated by being viewed from the side or at a squint angle will be decreased.

In the above process of reference voltage binding, Gx refers to a gray scale corresponding to a brightness inversion when a gray scale G of a pixel unit is converted to a combination of a gray scale Gm of the main pixel region and a gray scale Gs of the sub pixel region S.

Figure 4:
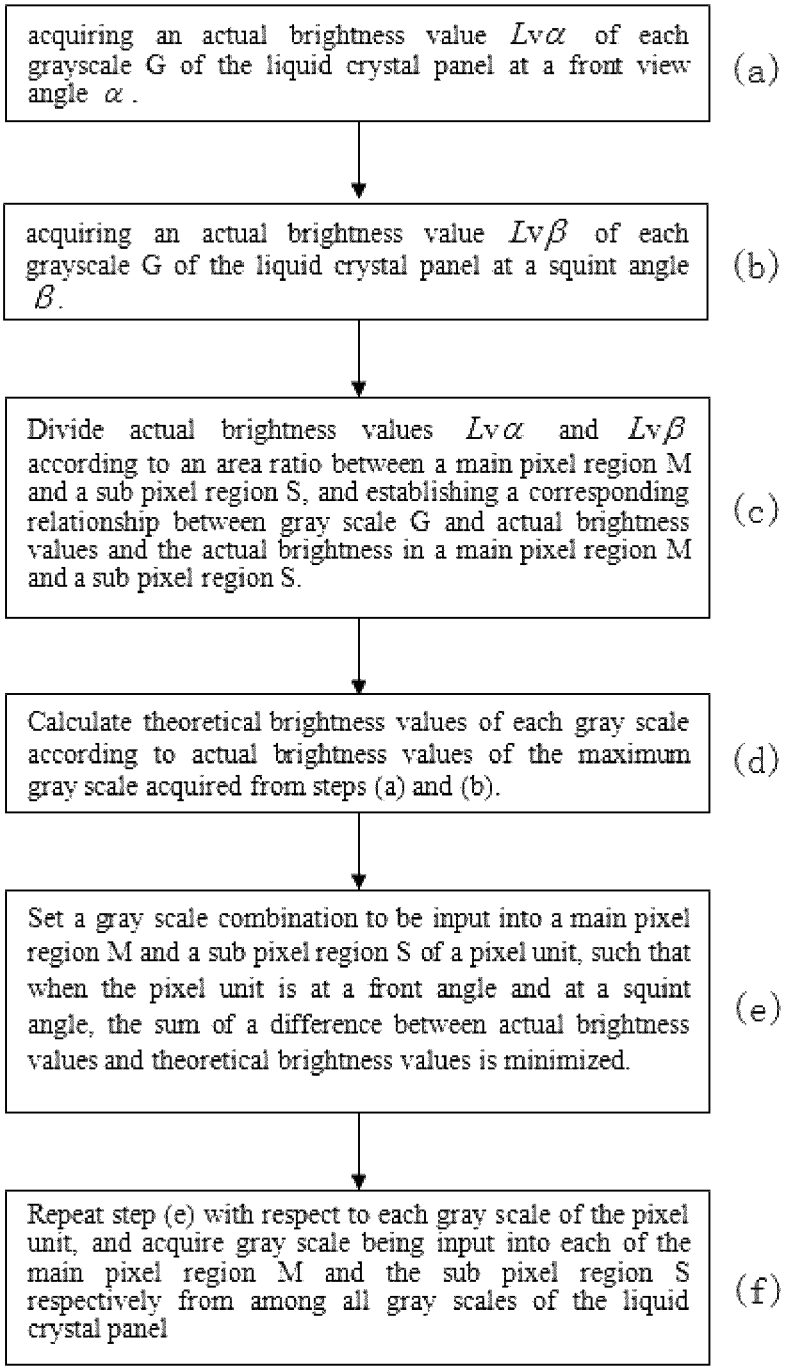
FIG. 4 is a flow chart of a gray scale conversion method provided in an embodiment of the present invention.

In particular, with respect to the converting of the gray scale G of a pixel unit to the combination of the gray scale Gm of the main pixel region M and the gray scale Gs of the sub pixel region S, the present embodiment provides the following method as shown in the flowchart of FIG. 4, the method includes:

(a) acquiring an actual brightness value Lvα of each gray scale G of the liquid crystal panel at a front angle α;

(b) acquiring an actual brightness value Lvβ of each gray scale G of the liquid crystal panel at a squint angle β;

(c) dividing the actual brightness values Lvα and Lvβ according to an area ratio between the main pixel region M and the sub pixel region S, and establishing a corresponding relationship between the gray scale G and the actual brightness values in the main pixel region M and the sub pixel region S. The actual brightness values Lvα and Lvβ are divided according to the following formulae:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;$$

acquiring actual brightness values LvMα and LvMβ of each gray scale G where the main pixel region M is at the front angle α and at the squint angle β, respectively; and acquiring actual brightness values LvSα and LvSβ of each gray scale G where the sub pixel region S is at the front angle α and at the squint angle β;

(d) calculating theoretical brightness values of each gray scale according to actual brightness values of a maximum gray scale acquired from steps (a) and (b), e.g., actual brightness values Lvα(max) and Lvβ(max) of the maximum gray scale, in conjunction with the formulae:

$$\text{gamma}(\gamma) = 2.2 \text{ and } \left(\frac{G}{\max}\right)^{\gamma} = \frac{LvG}{Lv(\max)};$$

and acquiring theoretical brightness values LvGα and LvGβ of each gray scale G where the liquid crystal panel is at the front angle α and at the squint angle β.

(e) setting a gray scale combination to be input into a main pixel region M and a sub pixel region S of a pixel unit, such that when the pixel unit is at a front angle and at a squint angle, the sum of a difference between actual brightness values and theoretical brightness values is minimized. In particular, with respect to one gray scale Gx in the pixel unit, assuming that the gray scales input into the main pixel region M and the sub pixel region S are Gmx and Gsx, respectively, actual brightness values LvMxα, LvMxβ, LvSxα and LvSxβ are obtained according the result of step (c), and theoretical brightness values LvGxα and LvGxβ are obtained according to the result of step (b), the following formulae are calculated:

$$\Delta 1=LvMx\alpha+LvSx\alpha-LvGx\alpha;$$

$$\Delta 2=LvMx\beta+LvSx\beta-LvGx\beta;$$

$$y=\Delta 1^2+\Delta 2^2;$$

when y reaches a minimum value, the corresponding gray scales Gmx and Gsx are set as the gray scales being respectively input into the main pixel region M and the sub pixel region S when the pixel unit is at a gray scale Gx;

(f) repeating step (e) with respect to each gray scale of the pixel unit, such that gray scales being input into each of the main pixel region M and the sub pixel region S respectively from among all gray scales of the liquid crystal panel are acquired.

In the present embodiment, the front angle is 0°, and the squint angle is 60°. In other embodiments, the squint angle may also be selected from a range of 30-80°. The front angle refers to a front view direction of the liquid crystal display, and the squint angle refers to an angle formed with respect to the front view direction of the liquid crystal display.

In the present embodiment, the gray scale of the liquid crystal panel includes 256 gray scales from 0 to 255, wherein the maximum gray scale max is 255 gray-scale.

As a specific example, the area ratio between the main pixel region M and the sub pixel region S is a:b=2:1, the front angle $\alpha=0°$, and the squint angle $\beta=60°$.

Figure 5:
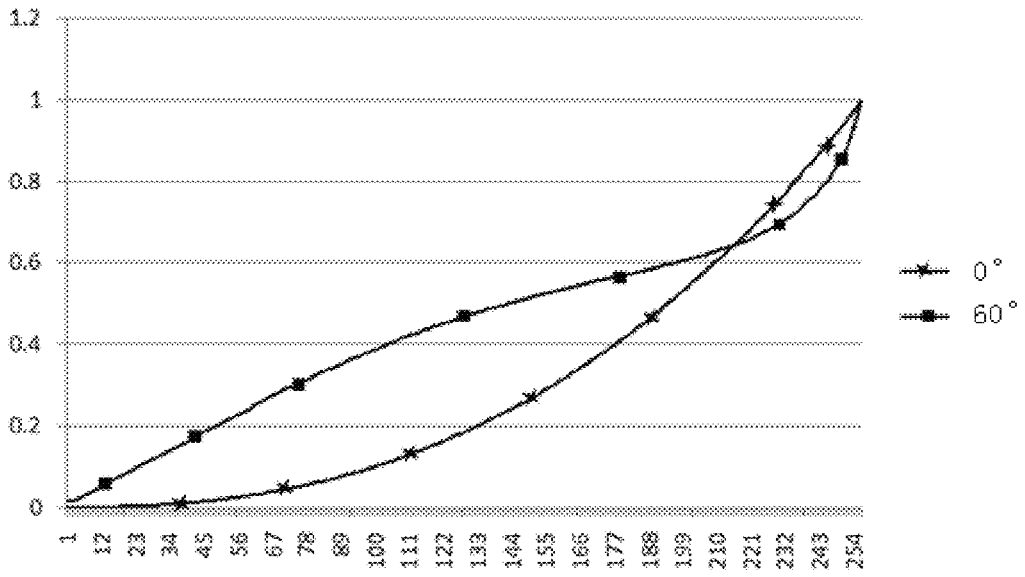
FIG. 5 is a gamma curve chart before conversion in a gray scale conversion method provided in an embodiment of the present invention.

First, gamma curves where the liquid crystal panel is at the front angle 0° and at the squint angle 60° are acquired, as shown in FIG. 5. Actual brightness values Lv0(0-255) and Lv60(0-255) of each gray scale G (0-255) at the front angle 0° and at the squint angle 60° are determined according to the gamma curves.

Then, according to the area ratio between the main pixel region M and the sub pixel region S of a:b=2:1, actual brightness values Lv0 and Lv60 are divided into LvM0, LvS0, LvM60 and LvS0, wherein the LvM0, LvS0, LvM60 and LvS0 satisfy the following formulae:

$$LvM0:LvS0=2:1,\ LvM0+LvS0=Lv0;$$

$$LvM60:LvS60=2:1,\ LvM60+LvS60=Lv60;$$

the actual brightness values LvM0(0-255) and LvM60(0-255) of each gray scale G (0-255) where the main pixel region M is at the front angle 0° and at the squint angle 60° are acquired; the actual brightness values LvS0(0-255) and LvS60(0-255) of each gray scale G(0-255) when the sub pixel region is at the front angle 0° and at the squint angle 60° are acquired, and a corresponding relationship between the gray scale G and the actual brightness value in the main pixel region M and the sub pixel region S is established.

Further, according to the actual brightness values Lv0 (255) and Lv60(255) of the maximum gray scale 255, the theoretical brightness values LvG0(0-255) and LvG60(0-255) of each gray scale G(0-255) where the liquid crystal panel is at the front angle 0° and at the squint angle 60° are calculated in conjunction with the formulae:

$$\text{gamma}(\gamma) = 2.2 \text{ and } \left(\frac{G}{255}\right)^{\gamma} = \frac{LvG}{Lv(255)};$$

and a corresponding relationship between the gray scale G and the theoretical brightness value is established.

Further, with respect to a gray scale Gx (Gx is one of 0-255) of the pixel unit, assuming that the gray scales input in the main pixel region M and the sub pixel region S are Gmx and Gsx, respectively, the actual brightness values LvMx0, LvMx60 LvSx0 and LvSx60 corresponding to the gray scales Gmx and Gsx may be acquired according to the above-mentioned corresponding relationship established between the gray scale G and the actual brightness value in the main pixel region M and the sub pixel region S, and the theoretical brightness values LvGx0 and LvGx60 corresponding to the gray scale Gx may be acquired according to the above-mentioned corresponding relationship established between the gray scale G and the theoretical brightness value; the following formulae are calculated:

$$\Delta1=LvMx0+LvSx0-LvGx0;$$

$$\Delta2=LvMx60+LvSx60-LvGx60;$$

$$y=\Delta1^2+\Delta2^2;$$

by combining the values of Gmx and Gsx several times, when a combination of the valued of Gmx and Gsx makes y reach a minimum value, such gray scales Gmx and Gsx are set as gray scales to be input into the main pixel region M and the sub pixel region S when the pixel unit is at a gray scale Gx.

Finally, the above step is repeated with respect to each gray scale G(0-255) of the pixel unit, and gray scales being input into each of the main pixel region M and the sub pixel region S from among all gray scales of the liquid crystal panel are acquired.

Figure 6:
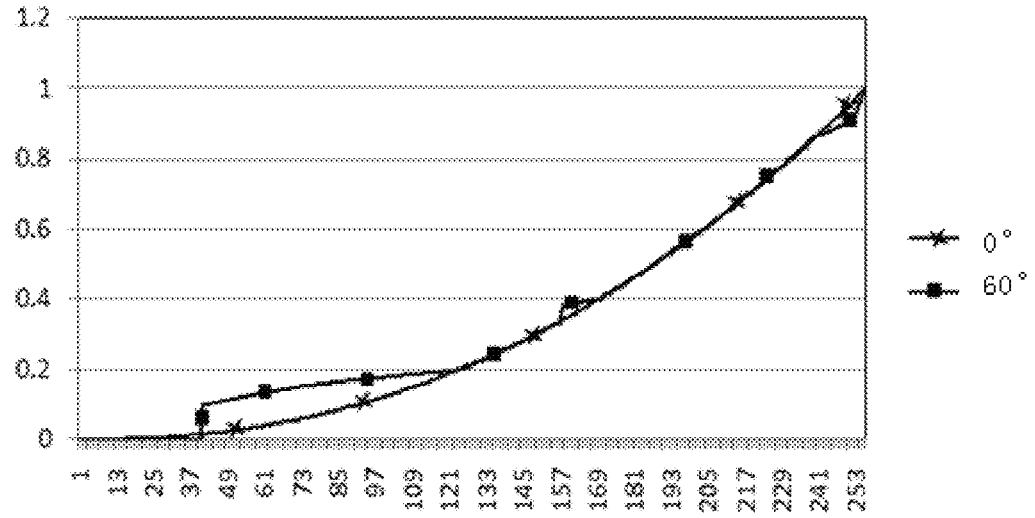
FIG. 6 is a gamma curve chart after conversion in a gray scale conversion method provided in an embodiment of the present invention.

In the present embodiment, after the gray scales of the main pixel region M and the sub pixel region S are adjusted, gamma curves when the liquid crystal panel is at a front angle 0° and at a squint angle 60° are as shown in FIG. 6. By setting the gray scales of the main pixel region M and the sub pixel region S, the acquired gamma curves become close to gamma($\gamma$)=2.2 when the main pixel region M and the sub pixel region S are at a front angle and at a squint angle, thus a good display effect can be achieved while decreasing the color shift, and in the case of assuring the display effect at a front angle will not obviously change, problems of light leaking and color shift at a wide view angle can be improved.

Figure 7:
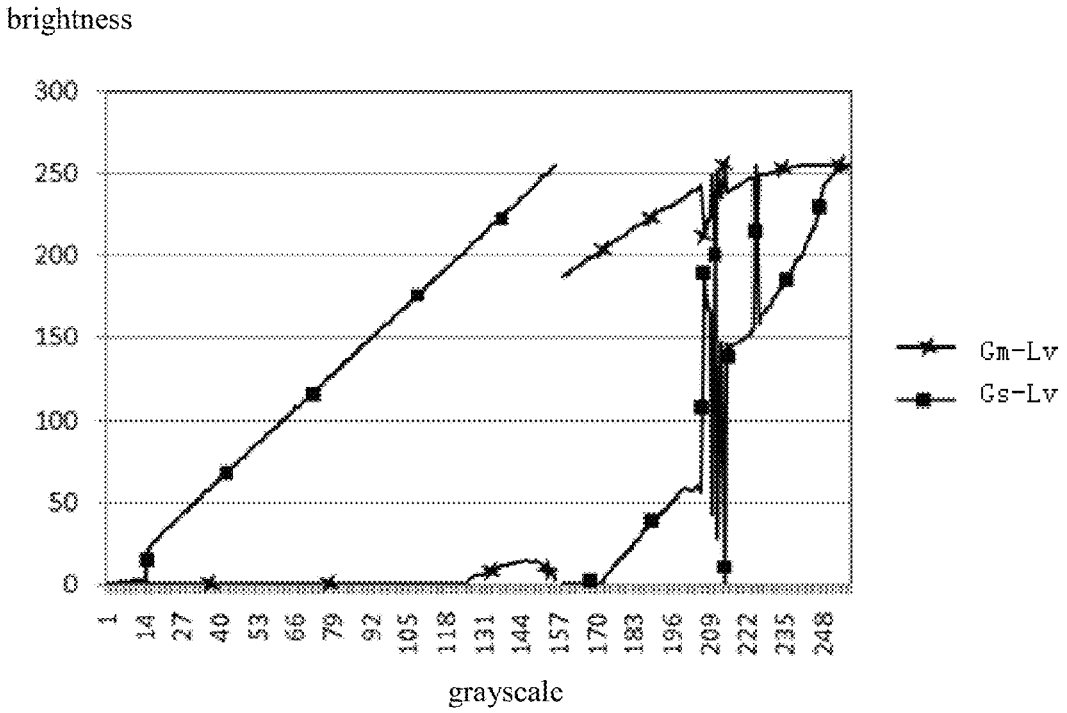
FIG. 7 is a relationship curve chart between gray scale and brightness after conversion of gray scale in an embodiment of the present invention.

FIG. 7 shows a Gm-Lv relationship curve between gray scale and brightness in the main pixel region M, and a Gs-Lv relationship curve between gray scale and brightness in the sub pixel region S, after the settings according to the above steps. In the relationship curves shown in FIG. 7, a gray scale inversion occurs at gray scale 157, and some singular discrete numerical points exist on the curve, which affects display quality of the liquid crystal display. In order to improve this problem, the following method can be used to smooth the relationship curve:

(1) a locally weighted scatter plot smoothing (LOWESS or LOESS) method can be used to perform the smoothing process. The method of LOWESS is similar to the moving average technique which is, in a specified window, a value of each point is obtained by performing a weighted regression to its adjacent values within the window, and the regression equation can be a linear equation or a quadratic equation. If within the width of the specified window, data points being smoothed on both sides of a data point to be smoothed are the same, then it is a symmetric LOWESS; if the data points on both sides thereof are different, then it is an unsymmetrical LOWESS. In general, a LOWESS method includes the following steps:

(a1) calculating initial weights of each data point within the specified window, a weighting function is usually expressed as a cubic function of Euclidean distance ratio between values;

(b1) performing a regression estimation by using the initial weights, defining a robust weight function by using a residual of the estimation, and calculating a new weight;

(c1) repeating step (b1) by using the new weight, modifying the weight function all the time, and a smooth value of any point may be acquired according to the polynomial and the weight after convergence in the Nth step.

A key parameter for performing data smoothing by using the LOWESS method is to select a width of the window, if the width is too large, then the historical data covered by the smoothed point is too much, and the influence of the latest price information on the smoothed value will be decreased; on the contrary, a window of which width is too narrow will make the "smoothed" data not so smooth.

Figure 8:
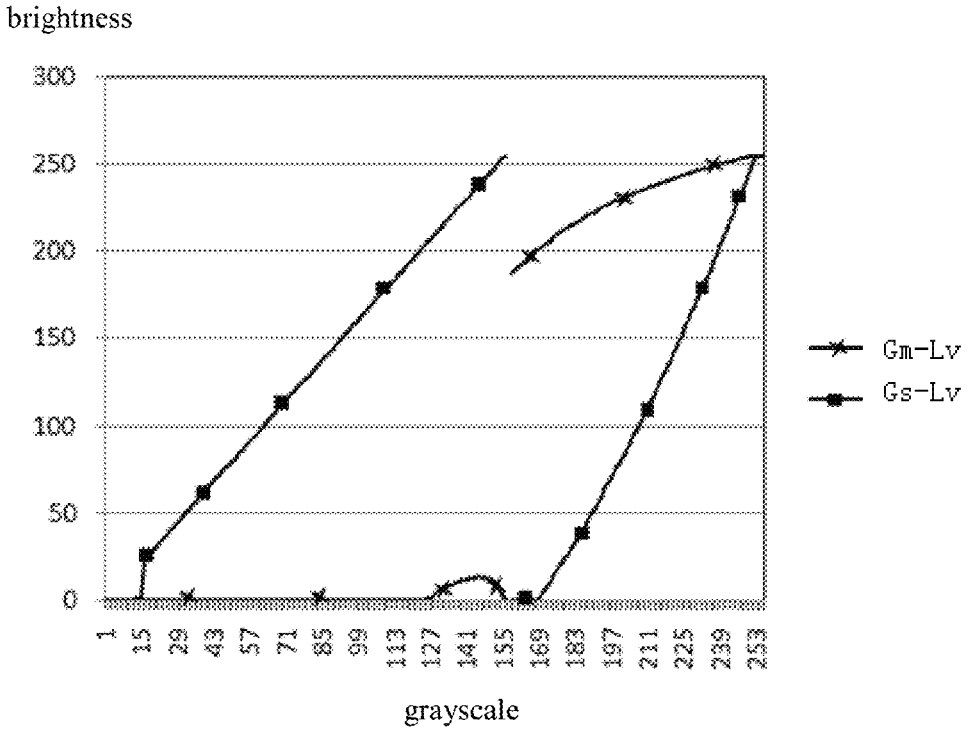
FIG. 8 is a diagram after a smoothing process on the curve shown in FIG. 6 is performed by using method 1 in an embodiment of the present invention.

In the present embodiment, FIG. 8 shows relationship curves between the gray scale and the brightness after being processed using the LOWESS method, the relationship curves include a Gm-Lv relationship curve of the main pixel region M and a Gs-Lv relationship curve of the sub pixel region S. The processed relationship curve is smooth, an error occurred in the initial calculation is modified, and the display quality of the liquid crystal display is improved.

(2) A power function fit process is employed. A curve-fit is performed after gray scale (e.g. gray scale 157 in the present embodiment) is inverted, wherein the expression of the power function used in the present embodiment is: f=m*x^n+k.

Figure 9:
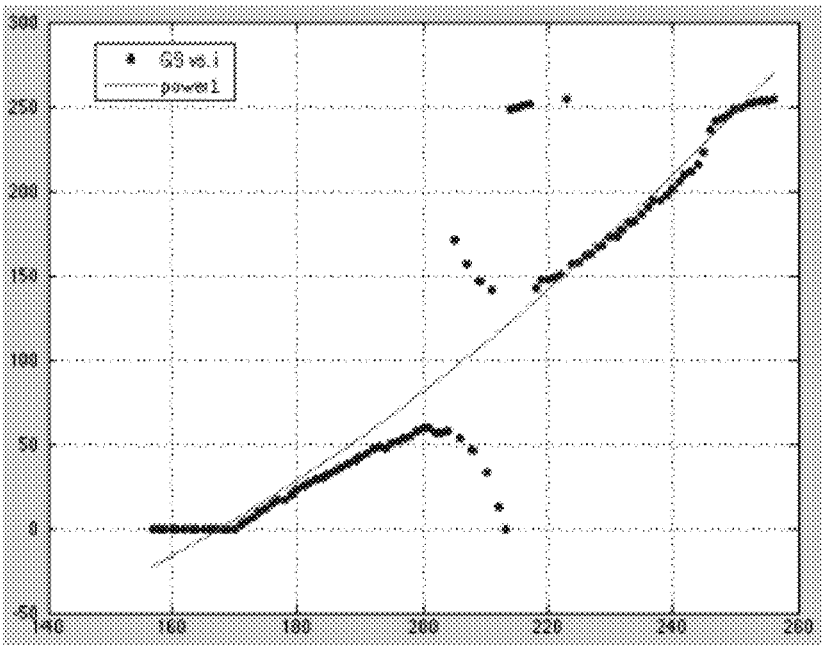
FIG. 9 is a diagram of procedure during which a smoothing process on the curve shown in FIG. 6 is performed by using method 2 in an embodiment of the present invention.
Figure 10:
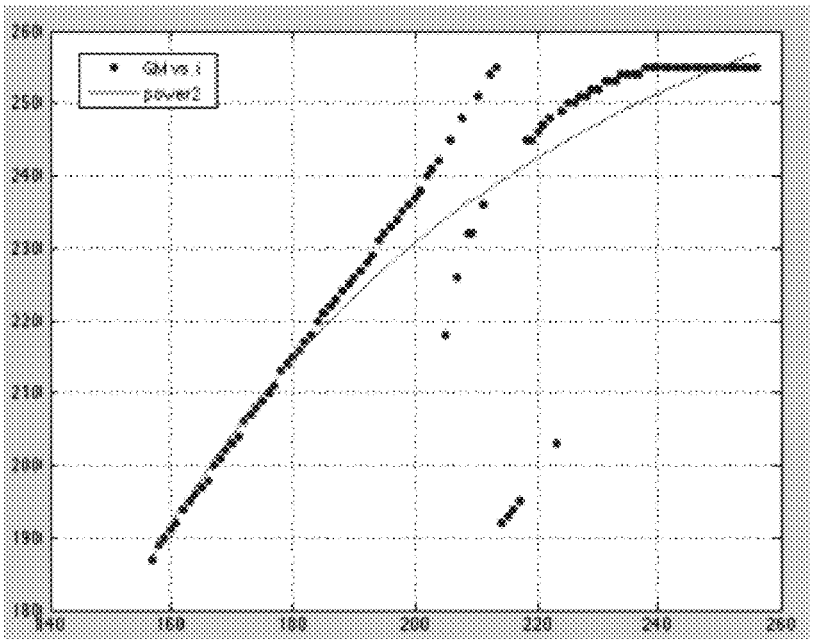
FIG. 10 is a diagram of procedure during which a smoothing process on the curve shown in FIG. 6 is performed by using method 2 in an embodiment of the present invention.

FIGS. 9 and 10 are diagrams of power function fit process. FIG. 9 is a diagram of fitting a Gs-Lv relationship curve between the gray scale and brightness of the sub pixel region S, in which the horizontal axis represents gray values starting from the inverted gray scale, and the vertical axis represents gray scales corresponding to the sub pixel region S, and the curve power1 is a curve obtained by fitting. FIG. 10 is a diagram of fitting a Gm-Lv relationship curve between the gray scale and the brightness of the main pixel region M, in which the horizontal axis represents gray values starting from the inverted gray scale, and the vertical axis represents gray scales corresponding to the main pixel region M, and the curve power2 is a curve obtained by fitting.

Figure 11:
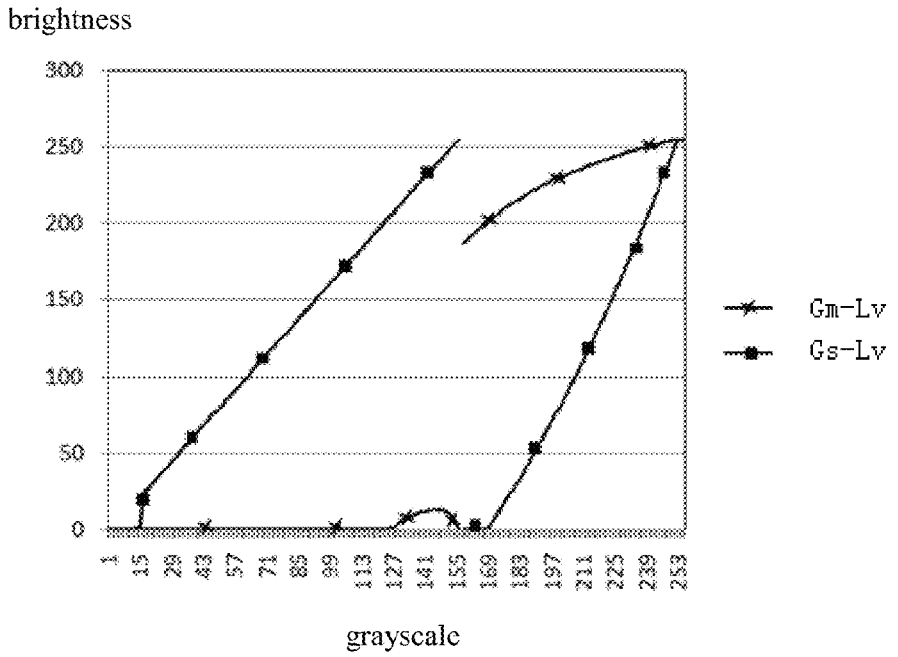
FIG. 11 is a diagram after a smoothing process on the curve shown in FIG. 6 is performed by using method 2 in an embodiment of the present invention.

In the present embodiment, FIG. 11 shows relationship curves between the gray scales and the brightness after being processed by a power function fit processing method, the relationship curves include a Gm-Lv curve of the main pixel region M and a Gs-Lv curve of the sub pixel region S. The processed relationship curve is smooth, the display quality of the liquid crystal display is improved, and the method of using power function fit is easy, quick and accurate.

Figure 12:
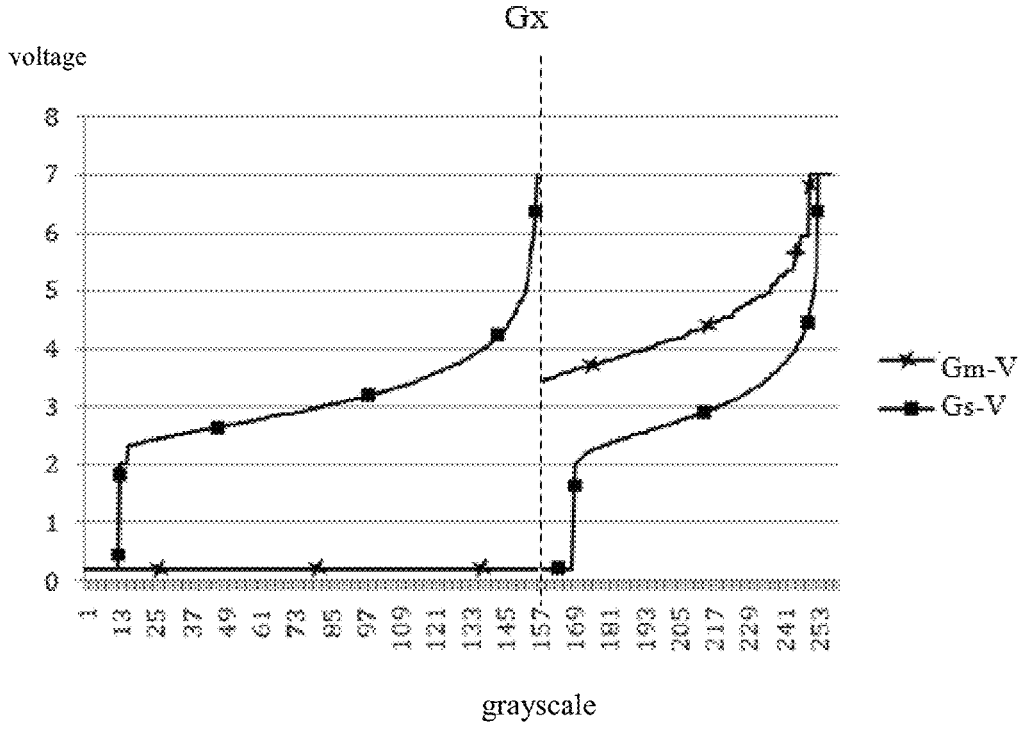
FIG. 12 is diagram of calculated Gm-V curve and Gs-V curve in an embodiment of the present invention.

Through the above acquired Gm-Lv curve and Gs-Lv curve, voltage values V required by Gm and Gs at each gray scale may be calculated, and the above acquired curves are converted into a Gm-V curve and a Gs-V curve, which include a Gm-V curve of the main pixel region M and a Gs-Lv curve of the sub pixel region S, as shown in FIG. 12.

It can be seen from the relationship curves 7, 8 and 11 between gray scale and brightness that, in the present embodiment, when the gray scale G of a pixel unit is converted into a combination of the gray scale Gm of the main pixel region M and the gray scale Gs of the sub pixel region S, a gray scale corresponding to the brightness inversion is 157, that is, Gx=157 in the present embodiment. Thus the reference voltage points bound in the first divider resistance string 52 and the second divider resistance string 53 are 0, 32, 128, 157, 158 and 255 gray-scale.

Figure 13:
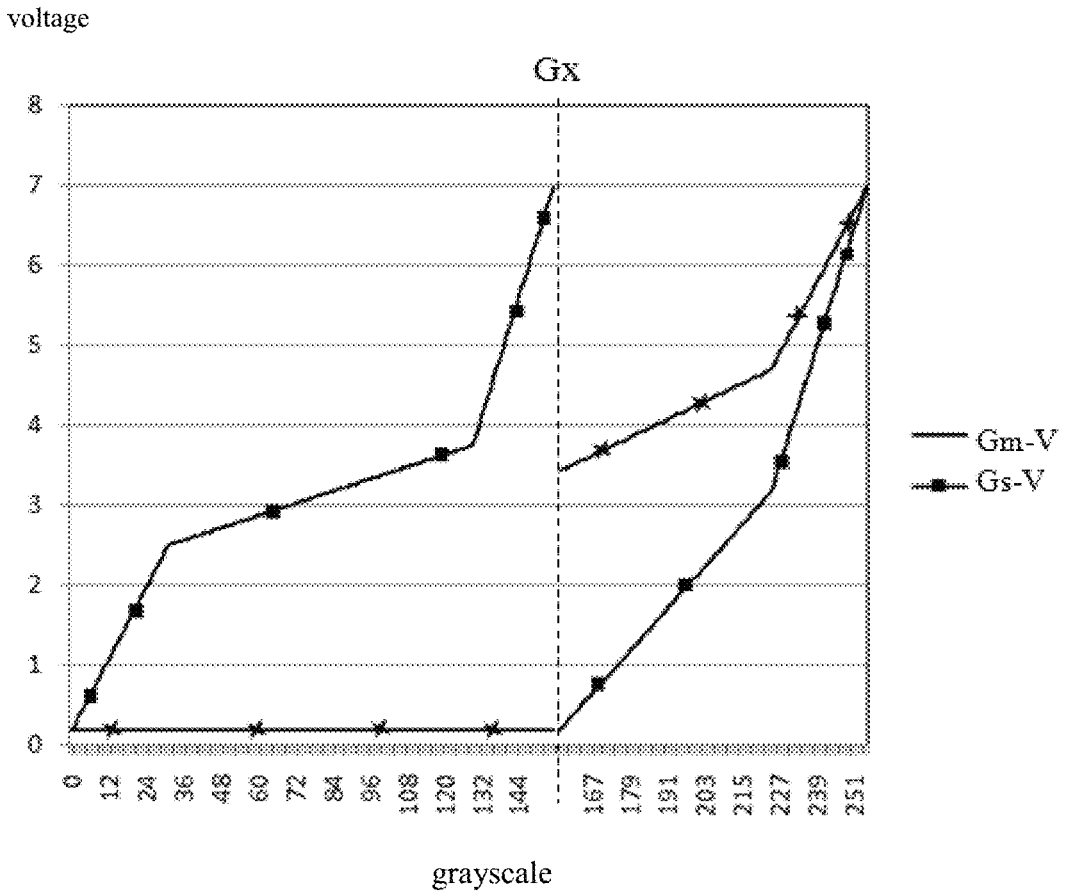
FIG. 13 is diagram of Gm-V curve and Gs-V curve after voltage binding in an embodiment of the present invention.

The Gm-V curve and Gs-V curve obtained after voltage binding are shown in FIG. 13, which include a Gm-V curve of the main pixel region M obtained after voltage binding and a Gs-Lv curve of the sub pixel region S obtained after voltage binding.

In conclusion, in the liquid crystal panel provided in the embodiment of the present invention, each pixel unit is divided into a main pixel region and a sub pixel region of which areas are different, and different display brightness and squint brightness are generated by inputting different data signals (different gray scale values) into the main pixel region and the sub pixel region, thereby color shift generated by being viewed from the side or at a squint angle is decreased. Furthermore, the Gamma voltage generating unit provided in the embodiment of the present invention can generate two groups of Gamma voltage of 0-255 gray scales to drive the main pixel region and the sub pixel region respectively in the 2D1G technology; and with respect to each group of the Gamma voltages, only Gamma voltage generating points at gray scales of 0, Gx, Gx+1 and 255 connected with the reference voltages needs to be voltage-bound, so that a number of bound voltages becomes small, thereby a difficulty of designing and producing a driving IC is lowered, and its manufacturing cost is saved.

The above description only illustrates specific embodiments of the present application, it should be noted that, to those ordinary skilled in the art, various improvements and modifications can be made without departing from the principle of the present application, and those improvements and polish should also be considered as the scope of the present application.

The invention claimed is:

1. A Gamma voltage generating module for supplying Gamma voltage to a liquid crystal panel comprising a plurality of pixel units, each of the pixel unit comprising a main pixel region M and a sub pixel region S, wherein the Gamma voltage generating module comprises:

a reference voltage unit for supplying reference voltages to a divider resistance string;

a first divider resistance string, coupled to the reference voltage unit, for dividing the reference voltages to form Gamma voltages corresponding to 0-255 gray scales, and supplying the Gamma voltages to the main pixel region M; and a second divider resistance string, coupled to the reference voltage unit, for dividing the reference voltages to form Gamma voltages corresponding to 0-255 gray scales, and supplying the Gamma voltages to the sub pixel region S;

wherein in the first divider resistance string and the second divider resistance string, the Gamma voltage generating points at least at gray scales of 0, Gx, Gx+1 and 255 connect with the reference voltages; wherein Gx refers to a gray scale corresponding to a brightness inversion when a gray scale G of a pixel unit is converted to a combination of a gray scale Gm of the main pixel region M and a gray scale Gs of the sub pixel region S.

2. The Gamma voltage generating module of claim 1, wherein the Gamma voltage generating points at gray scales of 0, 32, 128, Gx, Gx+1 and 255 connect with the reference voltages.

3. The Gamma voltage generating module of claim 2, wherein the reference voltages respectively connecting to the first divider resistance string and the second divider resistance string are different.

4. The Gamma voltage generating module of claim 1, wherein the reference voltages respectively connecting to the first divider resistance string and the second divider resistance string are different.

5. The Gamma voltage generating module of claim 1, wherein the following method is adopted to covert the gray scale G of a pixel unit into the combination of the gray scale Gm of the main pixel region M and the gray scale Gs of the sub pixel region S, the method comprising:

S101: acquiring an actual brightness value Lv$\alpha$ of each gray scale G of the liquid crystal panel at a front angle $\alpha$;

S102: acquiring an actual brightness value Lv$\beta$ of each gray scale G of the liquid crystal panel at a squint angle $\beta$;

S103: dividing each pixel unit of the liquid crystal panel into the main pixel region M and the sub pixel region S of which an area ratio is a:b, and dividing the actual brightness values Lvα and Lvβ according to the following formulae:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;$$

acquiring actual brightness values LvMα and LvMβ of each gray scale G where the main pixel region M is at the front angle α and the squint angle β, respectively; acquiring actual brightness values LvSα and LvSβ of each gray scale G respectively where the sub pixel region S is at the front angle α and the squint angle β;

S104: according to actual brightness values Lvα(max) and Lvβ(max) of a maximum gray scale max acquired in steps S101 and S102, calculating theoretical brightness values LvGα and LvGβ of each gray scale G where the liquid crystal panel is at the front angle α and the squint angle β in conjunction with the formulae:

$$\text{gamma}(\gamma) = 2.2 \text{ and } \left(\frac{G}{\max}\right)^{\gamma} = \frac{LvG}{Lv(\max)};$$

S105: with respect to a gray scale Gx of the pixel unit, if gray scales input in the main pixel region M and the sub pixel region S are Gmx and Gsx respectively, actual brightness values LvMxα, LvMxβ, LvSxα and LvSxβ are acquired according to result of step S103, and theoretical brightness values LvGxα and LvGxβ are acquired according to result of step S104, calculating the following formulae:

$$\Delta 1=LvMx\alpha+LvSx\alpha-LvGx\alpha;$$

$$\Delta 2=LvMx\beta+LvSx\beta-LvGx\beta;$$

$$y=\Delta 1^2+\Delta 2^2;$$

when y reaches a minimum value, setting corresponding gray scales Gmx and Gsx as gray scales being respectively input into the main pixel region M and the sub pixel region S when the pixel unit is at the gray scale Gx;

S106: repeating step S105 with respect to each gray scale G of the pixel unit, and acquiring the gray scales Gm and Gs being input into each of the main pixel region M and the sub pixel region S respectively from among all gray scales of the liquid crystal panel.

6. The Gamma voltage generating module of claim 5, wherein the front angle is 0°, and the squint angle is 30-80°.

7. The Gamma voltage generating module of claim 6, wherein the squint angle is 60°.

8. The Gamma voltage generating module of claim 5, wherein the gray scales of the liquid crystal panel includes 256 gray scales from 0 to 255, wherein a maximum gray scale max is 255 gray-scale.

9. The Gamma voltage generating module of claim 5, wherein the actual brightness values Lvα and Lvβ are determined according to gamma curves acquired when the liquid crystal panel is at the front angle α and at the squint angle β.

10. The Gamma voltage generating module of claim 5, wherein after step S106, a Gm-Lv curve of a relationship between gray scale and brightness of the main pixel region M, and a Gs-Lv curve of a relationship between gray scale and brightness of the sub pixel region S are obtained, and singular points appeared in the Gm-Lv curve and the Gs-Lv curve are processed by using a locally weighted scatter plot smoothing method or processed by using power function fit, wherein an expression of the power function is: f=m*x^n+k.

11. A liquid crystal panel, comprising:

a plurality of pixel units, each of the pixel units comprising a main pixel region M and a sub pixel region S driven by same scanning signals and different data signals;

a gate driving module for supplying the scanning signals to the pixel units;

a source driving module for supplying the data signals to the pixel units;

a Gamma voltage generating module for supplying two groups of Gamma voltages to the source driving module, such that the source driving module supplies the data signals to each of the main pixel region M and the sub pixel region S, wherein the Gamma voltage generating module comprises:

a reference voltage unit for supplying reference voltages to a divider resistance string;

a first divider resistance string, coupled to the reference voltage unit, for dividing the reference voltages to form Gamma voltages corresponding to 0-255 gray scales, and supplying the Gamma voltages to the main pixel region M; and a second divider resistance string, coupled to the reference voltage unit, for dividing the reference voltages to form Gamma voltages corresponding to 0-255 gray scales, and supplying the Gamma voltages to the sub pixel region S;

wherein in the first divider resistance string and the second divider resistance string, the Gamma voltage generating points at least at gray scales of 0, Gx, Gx+1 and 255 connect with the reference voltages; wherein Gx refers to a gray scale corresponding to a brightness inversion when a gray scale G of a pixel unit is converted to a combination of a gray scale Gm of the main pixel region M and a gray scale Gs of the sub pixel region S.

12. The liquid crystal panel of claim 11, wherein the Gamma voltage generating points at gray scales of 0, 32, 128, Gx, Gx+1 and 255 connect with the reference voltages.

13. The liquid crystal panel of claim 12, wherein the reference voltages respectively connecting to the first divider resistance string and the second divider resistance string are different.

14. The liquid crystal panel of claim 11, wherein the reference voltages respectively connecting to the first divider resistance string and the second divider resistance string are different.

15. The liquid crystal panel of claim 11, wherein the following method is adopted to covert the gray scale G of a pixel unit into the combination of the gray scale Gm of the main pixel region M and the gray scale Gs of the sub pixel region S, the method comprising:

S101: acquiring an actual brightness value Lvα of each gray scale G of the liquid crystal panel at a front angle α;

S102: acquiring an actual brightness value Lvβ of each gray scale G of the liquid crystal panel at a squint angle β;

S103: dividing each pixel unit of the liquid crystal panel into the main pixel region M and the sub pixel region S of which an area ratio is a:b, and dividing the actual brightness values Lvα and Lvβ according to the following formulae:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;$$

acquiring actual brightness values LvMα and LvMβ of each gray scale G where the main pixel region M is at the front angle α and the squint angle β, respectively; acquiring actual brightness values LvSα and LvSβ of each gray scale G respectively where the sub pixel region S is at the front angle α and the squint angle β;

S104: according to actual brightness values Lvα(max) and Lvβ(max) of a maximum gray scale max acquired in steps S101 and S102, calculating theoretical brightness values LvGα and LvGβ of each gray scale G where the liquid crystal panel is at the front angle α and the squint angle β in conjunction with the formulae:

$$\text{gamma}(\gamma) = 2.2 \text{ and } \left(\frac{G}{\max}\right)^{\gamma} = \frac{LvG}{Lv(\max)};$$

S105: with respect to a gray scale Gx of the pixel unit, if gray scales input in the main pixel region M and the sub pixel region S are Gmx and Gsx respectively, actual brightness values LvMxα, LvMxβ, LvSxα and LvSxβ are acquired according to result of step S103, and theoretical brightness values LvGxα and LvGxβ are acquired according to result of step S104, calculating the following formulae:

$$\Delta 1 = LvMx\alpha + LvSx\alpha - LvGx\alpha;$$

$$\Delta 2 = LvMx\beta + LvSx\beta - LvGx\beta;$$

$$y = \Delta 1^2 + \Delta 2^2;$$

when y reaches a minimum value, setting corresponding gray scales Gmx and Gsx as gray scales being respectively input into the main pixel region M and the sub pixel region S when the pixel unit is at the gray scale Gx;

S106: repeating step S105 with respect to each gray scale G of the pixel unit, and acquiring the gray scales Gm and Gs being input into each of the main pixel region M and the sub pixel region S respectively from among all gray scales of the liquid crystal panel.

16. The liquid crystal panel of claim 15, wherein the front angle is 0°, and the squint angle is 30-80°.

17. The liquid crystal panel of claim 16, wherein the squint angle is 60°.

18. The liquid crystal panel of claim 15, wherein the gray scales of the liquid crystal panel includes 256 gray scales from 0 to 255, wherein a maximum gray scale max is 255 gray-scale.

19. The liquid crystal panel of claim 15, wherein the actual brightness values Lvα and Lvβ are determined according to gamma curves acquired when the liquid crystal panel is at the front angle α and at the squint angle β.

20. The liquid crystal panel of claim 15, wherein after step S106, a Gm-Lv curve of a relationship between gray scale and brightness of the main pixel region M, and a Gs-Lv curve of a relationship between gray scale and brightness of the sub pixel region S are obtained, and singular points appeared in the Gm-Lv curve and the Gs-Lv curve are processed by using a locally weighted scatter plot smoothing method or processed by using power function fit, wherein an expression of the power function is: f=m*x^n+k.

* * * * *